US006472362B1

(12) United States Patent
Appel et al.

(10) Patent No.: US 6,472,362 B1
(45) Date of Patent: Oct. 29, 2002

(54) DETERGENT COMPOSITIONS IN TABLET FORM

(75) Inventors: Peter William Appel; Edwin Leo Lempers; Henning Wagner, all of Vlaardingen (NL)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/530,037

(22) PCT Filed: Oct. 9, 1998

(86) PCT No.: PCT/EP98/06632

§ 371 (c)(1),
(2), (4) Date: Apr. 24, 2000

(87) PCT Pub. No.: WO99/20730

PCT Pub. Date: Apr. 29, 1999

(30) Foreign Application Priority Data

Oct. 22, 1997 (GB) ..... 9722346
Mar. 24, 1998 (GB) ..... 9806294

(51) Int. Cl.[7] ..... C11D 17/00; C11D 1/83; C11D 3/065; C11D 11/00

(52) U.S. Cl. ..... 510/446; 510/294; 510/298; 510/361; 510/510; 510/512

(58) Field of Search ..... 510/294, 298, 510/446, 361, 510, 512

(56) References Cited

U.S. PATENT DOCUMENTS

| | | | | | |
|---|---|---|---|---|---|
| 3,018,267 | A | | 1/1962 | Steckler et al. | 260/45.4 |
| 3,324,038 | A | | 6/1967 | Chaffee et al. | 252/152 |
| 3,370,015 | A | * | 2/1968 | Van Kampen et al. | 510/446 |
| 3,383,321 | A | * | 5/1968 | Davis et al. | 510/298 |
| 3,451,928 | A | | 6/1969 | Fischer | 252/135 |
| 3,461,074 | A | * | 8/1969 | Schwalley | 510/349 |
| 3,557,003 | A | | 1/1971 | Morris et al. | 252/90 |
| 3,953,350 | A | | 4/1976 | Fujino et al. | 252/94 |
| 4,497,715 | A | * | 2/1985 | Bauman | 252/8.8 |
| 5,225,100 | A | | 7/1993 | Fry et al. | 252/174.25 |
| 5,866,531 | A | * | 2/1999 | Assmann et al. | 510/446 |
| 5,900,399 | A | * | 5/1999 | Seiter et al. | 510/446 |
| 6,051,545 | A | * | 4/2000 | Boskamp | 510/446 |

FOREIGN PATENT DOCUMENTS

| | | | |
|---|---|---|---|
| DE | 44 04 279 | | 8/1995 |
| DE | 44 29 550 | | 2/1996 |
| EP | 355 626 | | 2/1990 |
| EP | 466485 | | 1/1992 |
| EP | 481 792 | | 4/1992 |
| EP | 0481793 | * | 4/1992 |
| EP | 482 627 | | 4/1992 |
| EP | 522 766 | | 1/1993 |
| EP | 711 827 | | 5/1996 |
| EP | 838 519 | | 4/1998 |
| EP | 839 906 | | 5/1998 |
| GB | 911024 | | 11/1962 |
| GB | 1080066 | | 8/1967 |
| GB | 1 241 754 | | 8/1971 |
| GB | 2 276 345 | | 9/1994 |
| JP | 60015500 | | 1/1985 |
| WO | 94/25563 | | 11/1994 |
| WO | 98/42816 | | 10/1998 |
| WO | 98/42817 | | 10/1998 |

* cited by examiner

*Primary Examiner*—Lorna M. Douyon
(74) *Attorney, Agent, or Firm*—Rimma Mitelman

(57) ABSTRACT

Detergent compositions in the form of tablets used in fabric washing which incorporate most of the surfactants in particles which constitute a substantial part but not all the composition of the tablet. The organic surfactant in this particles provides a substantial part but not all of the weight of the particles. The mixture of anionic and nonionic detergent surfactants is employed wherein anionic is clearly in the majority. The balance of the composition contains a substantial proportion of material other than organic surfactant which is water-soluble.

15 Claims, 1 Drawing Sheet

DETERGENT COMPOSITIONS IN TABLET FORM

Figure 1A:
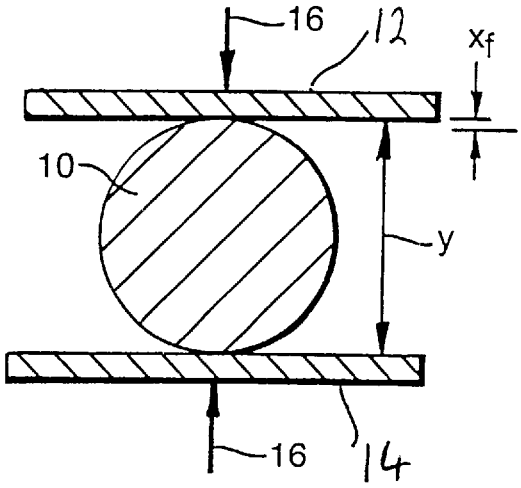

This invention relates to detergent compositions in the form of tablets for use in fabric washing.

Detergent compositions in tablet form have been described in, for example, GB 911204 (Unilever), U.S. Pat. No. 3,953,350 (Kao), JP 60-015500A (Lion), and EP-A-711827 (Unilever) and are sold commercially in Spain. Tablets have several advantages over powdered products: they do not require measuring and are thus easier to handle and dispense into the washload, and they are more compact, hence facilitating more economical storage.

Such tablets are generally made by compressing or compacting a quantity of detergent composition in particulate form. It is desirable that tablets should have adequate mechanical strength when dry, before use, yet disintegrate and disperse/dissolve quickly when added to wash water. It has not proved simple to achieve both properties simultaneously. As more pressure is used when a tablet is compacted, so the tablet density and strength rise, but the speed of disintegration/dissolution when the tablet comes into contact with wash water goes down.

During a period from about 1960 to 1970 there was considerable research in connection with tablets for use in fabric washing. A number of patents were published by major detergent manufacturers. Detergent tablets were sold commercially in USA and some European countries.

However, tablets disappeared from the market place in nearly all countries (Spain was the apparent exception) even though tablets have apparent advantages and have become known as a product form for machine dishwashing compositions which are characterised by a low content of organic surfactant.

U.S. Pat. No. 3,018,267 (Procter & Gamble) taught that the force, and hence pressure, applied when compacting a composition into tablets should be limited, or else the tablets would take too long to dissolve.

The compression pressure used in the Examples of this document was from 180 to 300 psi (approximately 1.2 to 2.1 MPa). Elsewhere in the document it is proposed that the pressure should not exceed 350 psi (approximately 2.5 MPa) to avoid slow disintegration encountered with higher pressures.

A number of proposals have been put forward as ways to improve the compromise between conflicting desiderata, but there still remains a desire to improve tablet strength without loss of speed of disintegration and vice versa. Some documents have proposed surface treatments or coatings to enhance tablet strength. For instance U.S. Pat. No. 3,451,928 (Colgate) stated that the problem of strength versus speed of dissolution remained unsolved, and proposed a treatment of spraying on water, followed by flash heating. U.S. Pat. No. 3,324,038 (Procter) proposed the application of a coating containing urea.

It is known to include materials whose function is to enhance disintegration of tablets when placed in wash water. Some tablets which are sold commercially incorporate urea for this purpose. Urea has a very high solubility in water exceeding 100 gms per 100 ml water at 20° C. EP-A-711827 teaches the use of sodium citrate for the-same purpose.

Detergent compositions, including tablet compositions, frequently contain a mixture of anionic and nonionic organic surfactants. It is often desirable to include both of these types of surfactant, for performance of the composition when washing fabrics.

We have now found that a good compromise between tablet strength and speed of disintegration can be achieved by following certain principles concerning tablet formulation and manufacture.

At the same time it is possible to incorporate materials which are desired to give good washing performance, and it is possible to formulate component ingredients of the tablet so that they are satisfactory in handling during tablet manufacture.

Also, we have found that two different measures of tablet strength are relevant to properties observed by a consumer. Force to cause fracture is a direct assessment of strength and indicates the tablets' resistance to breakage when handled by a consumer at the time of use. The amount of energy (or mechanical work) put in prior to fracture is a measure of table deformability and is relevant to the tablets' resistance to breakage during transport.

Both properties are relevant to consumers' perception of tablets: consumers will want tablets to be strong enough to handle, to reach them intact, and to disintegrate quickly and fully at the time of use. By following this invention's principles as to formulation, it is possible to achieve a good combination of these properties.

In this invention, we have found it desirable to incorporate most (if not all) of the surfactants in particles which constitute a substantial part but by no means all the composition of a tablet. The organic surfactant in these particles provides a substantial part, but by no means all, of their weight. Secondly, it is desirable to use a mixture of anionic and nonionic detergent surfactants where both are present in significant amounts, but anionic is clearly in the majority.

Thirdly, the balance of the composition should then contain a substantial proportion of material, other than organic surfactant, which is water soluble. This approach to formulation may be applied to the composition of a whole tablet, or to an individual region of a tablet with a plurality of distinct regions, e.g. layers.

So, according to a first aspect of this invention, there is provided a detergent tablet of compressed particulate composition wherein the tablet or a region thereof comprises organic surfactant and water-insoluble detergency builder, characterised in that the tablet or region thereof contains from 30 to 65% by weight (of the tablet or region as the case may be) of particles which contain from 20 to 50% by weight (of these particles) of non-soap organic surfactant which is anionic and nonionic surfactants in a ratio from 5:1 to 1.5:1 and in that in addition to said particles the tablet or region contains at least 15% by weight (of the tablet or region respectively) of substance which is other than soap or organic surfactant and which has a solubility in water of at least 10 gm/litre at 20° C.

We believe that concentrating most or all of the surfactant into surfactant-rich particles, and using a substantial proportion of anionic surfactant is beneficial in providing tablets which have both strength and elasticity, while allowing the remainder of the tablet composition to contain a substantial proportion of water-soluble material which assists disintegration of the tablets at the time of use.

Some, preferably at least two-thirds and more preferably at least 90% of the water-insoluble detergency builder may be present in these particles which contain the organic surfactant.

It is not necessary to include surfactant as a binder material in the part of the composition outside the surfactant-rich particles. Excluding it from this part of the composition is advantageous, to avoid interference with the prompt disintegration of this part of the composition.

Preferably, the weight of the anionic surfactant in the particles is at least 1.7 times the weight of the nonionic surfactant in them. More preferably, this weight ratio of anionic surfactant to nonionic surfactant lies in a range from 2:1 up to 5:1, and more preferably from 2:1 to 4:1. Preferably these particles contain at least 80% by weight better at least 90% or even 95% of all the organic surfactant (including any soap) in the tablet or region.

The water-soluble material which is present in the composition, externally to the surfactant-rich particles, preferably comprises at least 15% by weight (of the tablet or region as the case may be) of substance which has a water-solubility of at least 50 gm/litre in distilled water at 20° C. Some materials have been found to dissolve particularly rapidly, and are preferred, as will be explained in more detail below.

It is strongly preferred that the water-soluble material which is present in the composition, externally to the surfactant-rich particles, is present as particles which are substantially free of surfactant, i.e. contain no more than 5% of their own weight of organic surfactant.

A preferred form of this invention provides a detergent tablet of compressed particulate composition, or a discrete region of such a tablet, containing (i) from 35 to 60 wt % (and probably from 41 to 53, 56 or 6 wt %) of particles which contain non-soap anionic surfactant, nonionic surfactant and water-insoluble detergency builder, (ii) from 15 to 40 wt % (and probably from 16 to 35 wt %) of particles which are substantially free of surfactant, i.e. contain at least 95% of their own weight of water soluble material but contain no more than 5% of their own weight of organic surfactant, and (iii) from 0 to 50 wt % of further particulate ingredients, wherein the first said particles (i) contain at least 20%, and preferably at least 22 or 24%, of their own weight of non-soap surfactant and in that the weight of anionic surfactant therein is from 1.5 to 5 times the weight of nonionic surfactant therein.

The second said particles (ii) which are substantially free of organic surfactant preferably contain at least 40% (by weight of these particles) of one or more materials selected from compounds with a water-solubility exceeding 50 grams per 100 grams water at 20° C.;

sodium tripolyphosphate containing at least 50% of its own weight of the phase I anhydrous form, and preferably partially hydrated so as to contain water of hydration in an amount which is at least 1% by weight of the sodium tripolyphosphate;

mixtures thereof.

As will be explained further below, these disintegration-promoting particles can also contain other forms of tripolyphosphate or other salts within the balance of their composition. In another aspect, this invention provides a tablet defined by reference to a test procedure described below. In this aspect the invention provides a detergent tablet of compressed particulate composition wherein the tablet or a discrete region of the tablet comprises particles which contain non-soap anionic surfactant, nonionic surfactant, preferably soap and other water-soluble ingredients, characterised in that the particles contain at least 20 wt % in total of the anionic and nonionic surfactants and in that a test tablet consisting of the said non-soap anionic surfactant, nonionic surfactant, and any soap in the same proportions, together with 15% by weight moisture has a breaking strength as herein defined of at least 0.04 MPa and a modulus as herein defined of not more than 10 MPa preferably not more than 8 MPa.

In a yet further aspect, this invention provides the use of particles containing a mixture of anionic and nonionic surfactants and detergency builder, where the concentration by weight of non-soap anionic surfactant is at least 1.5 times as great as the concentration by weight of nonionic surfactant and the total concentration of these surfactants is at least 20 wt % of the particles to provide improvements in tablet strength and elasticity versus speed of disintegration.

A tablet of the invention may be either homogeneous or heterogeneous. In the present specification, the term "homogeneous" is used to mean a tablet produced by compaction of a single particulate composition, but does not imply that all the particles of that composition will necessarily be of identical composition. The term "heterogeneous" is used to mean a tablet consisting of a plurality of discrete regions, for example layers, inserts or coatings, each derived by compaction from a particulate composition. in a heterogenous tablet according to the present invention, each discrete region of the tablet will preferably have a mass of at least 5 gm.

In a heterogeneous tablet, at least one and possibly more of the discrete regions contains the mixed anionic and nonionic surfactants and detergency builder in accordance with the invention.

DRAWINGS

Figure 1B:
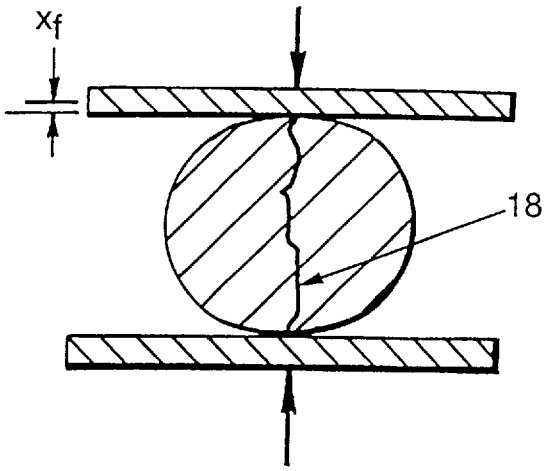
Figure 2:
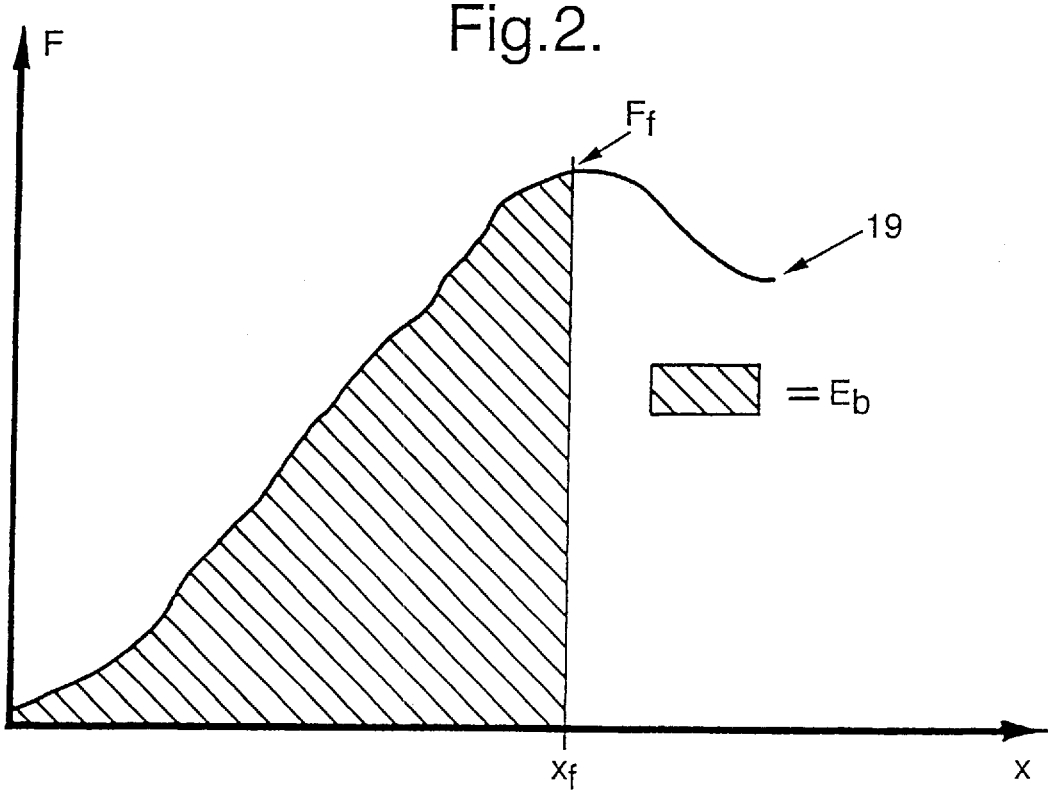

The accompanying drawings diagrammatically illustrate the testing of a cylindrical tablet:

FIG. 1*a* shows a tablet when first contacted by the platens of an Instron testing machine, FIG. 1*b* shows the tablet at the point of failure, FIG. 2 diagrammatically illustrates the form of a graph obtained during testing.

TABLET TESTING

We have tested the speed of disintegration of tablets by means of a test procedure in which a tablet was placed on a plastic sieve with 2mm mesh size which is immersed in 9 litres of demineralised water at ambient temperature of 20° C. The water conductivity is monitored until it reached a constant value. The time for dissolution of the tablets is taken as the time ($T_{90}$) for change in the water conductivity to reach 90% of its final magnitude.

We have tested tablet strength by a procedure illustrated by the accompanying drawings in which a cylindrical tablet 10 is compressed radially between the platens 12,14 of a materials testing machine until the tablet fractures. At the starting position shown in FIG. 1*a*, the platens 12, 14 contact the tablet but do not apply force to it. Force is applied, as indicated by the arrows 16 to compress the tablet. The testing machine measures the applied force (F), and also the displacement (x) of the platens towards each other as the tablet is compressed. The distance (y) between the platens before force is applied, which is the diameter of the tablet, is also known. At failure, illustrated in FIG. 1*b* the tablet cracks (eg as shown at 18) and the applied force needed to maintain the displacement drops. Measurement is discontinued when the applied force needed to maintain the displacement has dropped by 25% from its maximum value as indicated 19 in FIG. 2. The displacement at failure ($X_f$) is indicated between FIGS. 1*a* and 1*b*.

A graph of force (F) against displacement (x) has the form illustrated by FIG. 2. The maximum force is the force at failure ($F_f$). From this measurement of force an older test parameter called diametral fracture stress can be calculated using the equation $$\sigma = \frac{2F_f}{\pi Dt}$$

where σ is the diametral fracture stress in Pascals, $F_f$ is the applied force in Newtons to cause fracture, D is the tablet diameter in metres and t is the tablet thickness in metres.

The force at failure divided by the area of a diametral plane through the tablet (approximately the area of the crack 18) is the breaking strength, with units of Pascals.

The break energy is the area under the graph of force against displacement, up to the point of break. It is shown shaded in FIG. 2 and is given by the equation:

$$E_b = \int_0^{x_f} F(x)\,dx$$

where $E_b$ is the break energy in joules, x is the displacement in metres,

F is the applied force in Newtons at displacement x, and $X_f$ is the displacement at failure.

The displacement at failure relative to the tablet diameter is the relative displacement $X_f$/y.

Breaking strength divided by relative displacement is a modulus, whose value is inverse to tablet elasticity.

Materials and Other Features

Materials which may be used in tablets of this invention will now be discussed in more detail.

Anionic Surfactant Compounds

Synthetic (i.e. non-soap) anionic surfactants are well known to those skilled in the art. The anionic surfactant may comprise, wholly or predominantly, linear alkyl benzene sulphonate of the formula

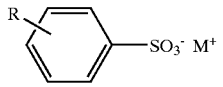

where R is linear alkyl of 8 to 15 carbon atoms and $M^+$ is a solubilising cation, especially sodium.

Primary alkyl sulphate having the formula $$ROSO_3^-M^+$$

in which R is an alkyl or alkenyl chain of 8 to 18 carbon atoms especially 10 to 14 carbon atoms and $M^+$ is a solubilising cation, is also commercially significant as an anionic surfactant and may be used in this invention.

Frequently, such linear alkyl benzene sulphonate or primary alkyl sulphate of the formula above, or a mixture thereof will be the desired non-soap anionic surfactant and may provide 75 to 100 wt % of any anionic non-soap surfactant in the composition.

Examples of other non-soap anionic surfactants include olefin sulphonates; alkane sulphonates; dialkyl sulphosuccinates; and fatty acid ester sulphonates.

One or more soaps of fatty acids may also be included in addition to the required non-soap anionic surfactant. Examples are sodium soaps derived from the fatty acids from coconut oil, beef tallow, sunflower or hardened rapeseed oil. These may be formed by adding fatty acid and a base such as sodium carbonate to a mixture which is used to form the surfactant-rich base particles.

Nonionic Surfactant Compounds

Nonionic surfactant compounds include in particular the reaction products of compounds having a hydrophobic group and a reactive hydrogen atom, for example, aliphatic alcohols, acids, amides or alkyl phenols with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially preferred are the primary and secondary alcohol ethoxylates, especially the $C_{9-11}$ and $C_{12-15}$ primary and secondary alcohols ethoxylated with an average of from 3 to 20 moles of ethylene oxide per mole of alcohol.

Detergency Builder

The composition which is compacted to form tablets or tablet regions will also contain water-insoluble detergency builder.

Alkali metal aluminosilicates are strongly favoured as environmentally acceptable water-insoluble builders for fabric washing. Alkali metal (preferably sodium) aluminosilicates may be either crystalline or amorphous or mixtures thereof, having the general formula:

$$0.8\text{–}1.5\ Na_2O.Al_2O_3.\ 0.8\text{–}6\ SiO_2.\ xH_2O$$

These materials contain some bound water (indicated as "xH2O") and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium aluminosilicates of this type are the well known commercially available zeolites A and X, the novel zeolite P described and claimed in EP 384070 (Unilever) and mixtures thereof.

Conceivably, water-insoluble detergency builder could be a layered sodium silicate as described in U.S. Pat. No. 4,664,839. NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, which can be used have the general formula $NaMSi_xO_{2x+1}.yH_2O$ wherein M is sodium or hydrogen, x is a number from 1.9 to 4, preferably 2, and y is a number from 0 to 20, preferably 0.

The tablet or region thereof may also contain some water-soluble detergency builder. Water-soluble phosphorous-containing inorganic detergency builders, include the alkali-metal orthophosphates, metaphosphates, pyrophosphates and polyphosphates. Specific examples of inorganic phosphate builders include sodium and potassium tripolyphosphates, orthophosphates and hexametaphosphates.

Non-phosphorous water-soluble builders may be organic or inorganic. Inorganic builders that may be present include alkali metal (generally sodium) carbonate; while organic builders include polycarboxylate polymers, such as polyacrylates and acrylic/maleic copolymers, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

Tablet compositions preferably include polycarboxylate polymers, more especially polyacrylates and acrylic/maleic copolymers which can function as builders and also inhibit unwanted deposition onto fabric from the wash liquor.

Proportions

Generally, a tablet or a region thereof in accordance with this invention will contain overall from 2 or 5 wt % up to 40 or 50 wt % non-soap surfactant, and from 5 or 10 wt % up to 60 or 80 wt % detergency builder.

The concentration of non-soap anionic surfactant in the tablet or a region thereof will generally be at least one and a half times the concentration of nonionic surfactant. It is preferably from 3wt % up to 30 or 40wt % of the tablet or region thereof. The concentration of nonionic surfactant is preferably from 2 to 15wt % of the tablet or region thereof.

The quantity of soap in the tablet or region thereof is preferably from 0.1 or 0.2 up to 2% by weight of the tablet or region thereof. More soap, such as up to 3 or 4% of the tablet or region thereof is less preferred.

Where a tablet is heterogenous, these percentage ranges may apply to the overall composition of the tablet, as well as to at least one region of the tablet.

In accordance with this invention, anionic non-soap surfactant, nonionic surfactant water-soluble detergency builder and other materials which preferably include soap are made into particles such that the non-soap surfactant provides from 20 to 50% of the weight of these particles. Preferably the non-soap surfactant provides at least 22%, more preferably at least 24% of the weight of these particles, and possibly at least 28% thereof.

When soap is present, it is desirably from 0.2 to 2% or 3% by weight of these particles, and in these particles the weight ratio of nonionic detergent to soap is preferably from 5:1 better 10:1 to 30:1. Greater amounts of soap, such as up to 4.5% are less preferred. The total quantity of soap and non-soap surfactant in the particles may be at least 30% of the weight of these particles, notably from 30 to 50 or 60%.

Such particles may be made by spray drying, or by a granulation process. Preferably they contain water-insoluble detergency builder in an amount which is from 30 to 80% of the weight of these particles, better 30 or 40 up to 60% of the weight of these particles.

The surfactant mixture used in these particles can be tested mechanically in directly analogous manner to the testing of tablets, discussed above. To do this a mixture of the non-soap surfactants and any soap is made on a small scale, and cast into cylindrical form or some other shape from which a cylinder can be cut. If necessary this is dried to reduce the water content to 15% by weight (approximating to 5% moisture in the particles which contain this surfactant mixture). Next, it is tested on a materials testing machine in the manner described above for testing of tablets. This mechanical testing procedure can also be applied to tablets made from the surfactant-rich particles alone.

We have found that the effect of anionic surfactant in these particles is to enhance elasticity without much effect on magnitude of the force to cause fracture. Nonionic surfactant tends to have some opposite effect. Soap when present, cooperates with the nonionic surfactant to reduce mobility of the nonionic surfactant and to increase tablet strength (as measured by force to cause failure).

By using sufficient quantities of anionic non-soap surfactant, nonionic surfactant and preferably soap we have found that it is possible to achieve adequate strength and elasticity of a test tablet which in turn signifies that the same mixture will give tablets with good strength and elasticity.

Breaking strength is desirably at least 0.4MPa preferably at least 0.5 MPa. The modulus is desirably no more than 10 MPa preferably no more than 8 or even 5 MPa.

We have observed that a mixture of alkylbenzene sulphonate and nonionic surfactant in ratio 1.16:1 gave a modulus of about 15 MPa but when the proportions were changed to 2.2:1 (in accordance with this invention) the modulus dropped dramatically to about 4.0 to 4.5 MPa, indicating greater elasticity, with very little change in force at failure.

Disintegration-promoting Particles

In addition to the required particles containing surfactants and builder, a tablet or tablet region of this invention contains water-soluble material serves to promote disintegration. Preferably this is provided as particles which are substantially free of organic surfactant.

One possibility is that these particles contain at least 50% of their own weight, better at least 80%, of a material which has a solubility in deionised water at 20° C. of at least 50 grams per 100 grams of water.

The said particles may provide material of such solubility in an amount which is at least 7 wt % or 12 wt % of the whole composition of the tablet or region thereof.

A solubility of at least 50 grams per 100 grams of water at 20° C. is an exceptionally high solubility: many materials which are classified as water soluble are less soluble than this.

Some highly water-soluble materials which may be used are listed below, with their solubilities expressed as grams of is solid to form a saturated solution in 100 grams of water at 20° C.:

| Material | Water Solubility (g/100 g) |
|---|---|
| Sodium citrate dihydrate | 72 |
| Potassium carbonate | 112 |
| Urea | >100 |
| Sodium acetate | 119 |
| Sodium acetate trihydrate | 76 |
| Magnesium sulphate $7H_2O$ | 71 |
| Potassium acetate | >200 |

By contrast the solubilities of some other common materials at 200° C. are:

| Material | Water Solubility (g/100 g) |
|---|---|
| Sodium chloride | 36 |
| Sodium sulphate decahydrate | 21.5 |
| Sodium carbonate anhydrous | 8.0 |
| Sodium percarbonate anhydrous | 12 |
| Sodium perborate anhydrous | 3.7 |
| Sodium tripolyphosphate anhydrous | 15 |

Preferably this highly water soluble material is incorporated as particles of the material in a substantially pure form (i.e. each such particle contains over 95% by weight of the material). However, the said particles may contain material of such solubility in a mixture with other material, provided that material of the specified solubility provides at least 50% by weight of these particles. Another possibility is that the said particles which promote disintegration are particles containing sodium tripolyphosphate with more than 50% of it (by weight of the particles) in the anhydrous phase I form.

Sodium tripolyphosphate is very well known as a sequestering builder in detergent compositions. It exists in a hydrated form and two crystalline anhydrous forms. These are the normal crystalline anhydrous form, known as phase II which is the low temperature form, and phase I which is stable at high temperature. The conversion of phase II to phase I proceeds fairly rapidly on heating above the transition temperature, which is about 420° C., but the reverse reaction is slow. Consequently phase I sodium tripolyphosphate is metastable at ambient temperature.

A process for the manufacture of particles containing a high proportion of the phase I form of sodium tripolyphosphate by spray drying below 420° C. is given in U.S. Pat. No. 4,536,377.

Particles which contain this phase I form will often contain the phase I form of sodium tripolyphosphate as at least 55% by weight of the tripolyphosphate in the particles. A further preference is that the sodium tripolyphosphate is partially hydrated. The extent of hydration should be at least 1% by weight of the sodium tripolyphosphate in the particles. It may lie in a range from 2.5 to 4%, or it may be higher. Indeed fully hydrated sodium tripolyphosphate may be used to provide these particles.

Suitable material is commercially available. Suppliers include Rhone-Poulenc, France and Albright & Wilson, UK.

Some countries require that phosphate is not used. For such countries, a zero phosphate tablet in accordance with this invention will preferably utilise 15% by weight or more of disintegration-promoting material with solubility of at least 50 gm/100 gm at 20° C. Other countries permit the use, or at least some limited use, of phosphates, making it possible to use some sodium tripolyphosphate. When these surfactant-free particles contain sodium tripolyphosphate, it will function as a builder after the tablet or tablet region disintegrates and dissolves in the wash liquor.

Other Ingredients

Detergent tablets according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the tablet.

Preferred inorganic persalts are sodium perborate monohydrate and tetrahydrate, and sodium percarbonate. Bleach activators have been widely disclosed in the art. Preferred examples include peracetic acid precursors, for example tetraacetylethylene diamine (TAED), and perbenzoic acid precursors. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

Bleach activator is usually present in an amount from 1 to 10% by weight of the tablet, possibly less in the case of a transition metal catalyst which may be used as 0.1% or more by weight of the tablet.

The detergent tablets of the invention may also contain one of the detergency enzymes well known in the art for their ability to degrade various soils and stains and so aid in their removal. Suitable enzymes include the various proteases, cellulases, lipases, amylases, and mixtures thereof, which are designed to remove a variety of soils and stains from fabrics. Detergency enzymes are commonly employed in the form of granules or marumes, optionally with a protective coating, in amount of from about 0.1% to about 3.0% by weight of the tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included, especially if a detergent tablet is primarily intended for use in front-loading drum-type automatic washing machines. Antifoam materials in granular form are described in EP 266863A (Unilever). Such antifoam granules typically comprise a mixture of silicone oil, petroleum jelly, hydrophobic silica and alkyl phosphate as antifoam active material, sorbed onto a porous absorbed water-soluble carbonate-based inorganic carrier material.

It may also be desirable that a detergent tablet of the invention includes an amount of an alkali metal silicate, particularly sodium ortho-, meta- or disilicate. The presence of such alkali metal silicates at levels, for example, of 1 to 10 wt %, may be advantageous in providing protection against the corrosion of metal parts in washing machines, besides providing some detergency building.

Further ingredients which can optionally be employed in fabric washing detergent tablet of the invention include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; and colorants or coloured speckles. These various other ingredients may be present in the surfactant-rich particles or in the balance of the composition outside them. It is preferred that any bleach is contained in the balance of the composition outside the surfactant-rich particles.

Particle Size and Distribution

A detergent tablet of this invention, or a region of such a tablet, is a matrix of compacted particles.

Preferably the particulate composition has an average particle size before compaction in the range from 200 to 2000 μm, more preferably from 250 to 1400 μm. Fine particles, smaller than 180 μm or 200 μm may be eliminated by sieving before tableting, if desired, although we have observed that this is not always essential.

While the starting particulate composition may in principle have any bulk density, the present invention is especially relevant to tablets made by compacting powders of relatively high bulk density, because of their greater tendency to exhibit disintegration and dispersion problems. Such tablets have the advantage that, as compared with a tablet derived from a low bulk density powder, a given dose of composition can be presented as a smaller tablet.

Thus the starting particulate composition may suitably have a bulk density of at least 400 g/litre, preferably at least 550 g/litre, and perhaps at least 600 g/litre.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

Tableting

Tableting entails compaction of the particulate composition. A variety of tableting machinery is known, and can be used. Generally it will function by stamping a quantity of the particulate composition which is confined in a die.

Tableting may be carried out without application of heat, so as to take place at ambient temperature or at a temperature above ambient. In order to carry out the tableting at a temperature which is above ambient, the particulate composition is preferably supplied to the tableting machinery at an elevated temperature. This will of course supply heat to the tableting machinery, but the machinery may be heated in some other way also.

If any heat is supplied, it is envisaged that this will be supplied conventionally, such as by passing the particulate composition through an oven, rather than by any application of microwave energy.

The size of a tablet will suitably range from 10 to 160 grams, preferably from 15 to 60 g, depending on the conditions of intended use, and whether it represents a dose for an average load in a fabric washing or dishwashing machine or a fractional part of such a dose. The tablets may be of any shape. However, for ease of packaging they are preferably blocks of substantially uniform cross-section, such as cylinders or cuboids. The overall density of a tablet preferably lies in a range from 1040 or 1050 gm/litre up to 1300 gm/litre. The tablet density may well lie in a range up to no more than 1250 or even 1200 gm/litre.

EXAMPLES 1–3

Tablets for use in fabric washing were made, starting with granulated base powders of the following compositions, made by mixing under high shear followed by densification under reduced shear:

| | parts by weight | | |
|---|---|---|---|
| Ingredient | Base 1 (comp) | Base 2 | Base 3 |
| Sodium linear alkylbenzene sulphonate | 8.0 | 9.2 | 9.3 |
| $C_{13-15}$ fatty alcohol 7EO. | 4.2 | 2.6 | 2.7 |
| $C_{13-15}$ fatty alcohol 3EO. | 2.2 | 1.4 | 1.4 |
| Soap | 1.0 | 0.7 | 0.7 |
| Zeolite A24* | 26 | 21.3 | 20.9 |
| Sodium citrate dihydrate | 2.7 | 2.6 | — |
| Sodium acetate trihydrate | — | — | 2.7 |
| Sodium carboxymethylcellulose | 0.5 | 0.4 | 0.4 |
| Sodium sulphate, moisture and minors | balance to 51 | balance to 46 | balance to 45 |

*Zeolite A24 is maximum aluminium zeolite P from Crosfields.

This powder was then mixed with further ingredients to form particulate compositions which were as follows:

| | % by weight | | |
|---|---|---|---|
| Ingredient | Ex 1 (comp) | Ex 2 | Ex 3 |
| Base powder 1 | 51 | | |
| Base powder 2 | | 46 | |
| Base powder 3 | | | 45 |
| Sodium perborate monohydrate | 14.3 | 13.3 | 13.3 |
| TAED granules | 5.5 | 5.1 | 5.1 |
| Anti-foam granules | 1.5 | 1.8 | 1.8 |
| Fluorescer granules | 1.0 | 1.0 | 1.0 |
| Sodium silicate granules | 3.7 | 3.5 | 3.5 |
| Acrylate/maleate copolymer | 1.0 | 1.0 | 1.3 |
| Sodium acetate trihydrate | 18.5 | 24 | 24.6 |

-continued

| | % by weight | | |
|---|---|---|---|
| Ingredient | Ex 1 (comp) | Ex 2 | Ex 3 |
| Perfume, enzymes and other minor ingredients | 3.5 | 4.3 | 4.4 |
| TOTAL | 100 | 100 | 100 |

40 g portions of each composition were made into cylindrical tablets of 44 mm diameter, using a Carver hand press, with sufficient applied pressure to produce tablets which dissolved to 90% of complete dissolution within four minutes, in water at 20° C., when tested as described above.

The strength was tested as described above.

Tablets were also made from the base powders alone, stamping with sufficient applied pressure to produce tablets with no porosity remaining between the compacted particles. The following table gives the results of strength tests on the fully formulated tablets, alongside the percentages and ratios of some ingredients. The tablets embodying the invention displayed higher force at failure and higher break energy. The table also includes the results of testing the mechanical properties of tablets without porosity stamped from the base powders alone. These latter results highlight the increased elasticity resulting from the higher proportion of anionic detergent active in the base powders 2 and 3.

| | Ex 1 (comp) | Ex 2 | Ex 3 |
|---|---|---|---|
| Powder: | | | |
| active system anionic/nonionic | 7/6 = 1.16:1 | 9/4 = 2.25:1 | 9/4 = 2.25:1 |
| content of base powder [%] | 51 | 46 | 45 |
| active in base [%] | 28 | 28.7 | 29.8 |
| active/zeolite ratio in base powder | 0.55 | 0.62 | 0.64 |
| level of disintegrant [%] | 18.5 | 24.0 | 27.3 |
| Tablet properties: | | | |
| force at failure [N] | 40.5 | 58.0 | 70.5 |
| break energy (mJ) | 6.5 | 14.0 | 22.0 |
| Properties of tablets made from the base powders alone: | | | |
| breaking strength [MPa] | 1.7 | 1.5 | 1.5 |
| modulus [MPa] | 56 | 35 | 35 |

EXAMPLE 4

Tablets for use in fabric washing were made, starting with a granulated base powder of the following composition:

| | % by weight |
|---|---|
| Coconut alkyl sulphate | 20.33 |
| Nonionic detergent ($c_{13-15}$ fatty alcohol 7EO) | 11.09 |
| Soap | 3.60 |
| Zeolite A24 | 42.42 |
| Sodium carboxymethyl cellulose | 1.68 |
| Sodium carbonate | 5.11 |
| Sodium citrate dihydrate | 6.37 |
| Moisture and other minor ingredients | 9.4 |

Samples of this powder were mixed with materials to promote disintegration and other detergent ingredients as follows:

| | % by weight |
|---|---|
| Base powder | 50.0 |
| Perborate monohydrate | 14.3 |
| TAED (83% active) granules | 5.5 |
| phosphonate | 0.65 |
| Sodium carbonate | 2.0 |
| Na-disilicate (80%) | 3.7 |
| Antifoam granules | 2.5 |
| Fluorescer granules (15% active) | 1.0 |
| Acrylate maleate copolymer | 1.0 |
| Enzymes | 0.90 |
| Perfume | 0.45 |
| Disintegration aid | 18 |

The various compositions were made into tablets and tested as in Examples 1–3. The materials used as disintegration promoter and the test results are set out in the following table:

| Disintegration promoter | Compaction force (kN) | Strength (DFS in kPa) | Break energy (millijoules) | Dissolution ($T_{90}$ in minutes) |
|---|---|---|---|---|
| 18% potassium | 4 | 54.7 | 15.5 | 2.35 |
| acetate | 6 | 76.8 | 19.0 | 4.3 |
| 10% Na-acetate | 4 | 54.3 | 11.5 | 3.65 |
| trihydrate with 8% K-acetate | 6 | 78.9 | 17.0 | 8.6 |

In modifications of this example, the amount of soap in the base powder was reduced from 3.6% to 2.6% and 1.6% and the amount of coconut alkyl sulphate was correspondingly increased by 1% or 2%.

What is claimed is:

1. A detergent tablet of compressed particulate composition wherein the tablet or a region thereof comprises organic surfactant and water-insoluble detergency builder, wherein the tablet or region thereof contains from 30 to 65%, by weight of the tablet or region respectively, of particles which contain from 20 to 50% by weight of these particles of non-soap organic surfactant which is anionic and nonionic surfactants in a weight ratio from 5:1 to 1.5:1 and wherein the particles include soap and the weight ratio of nonionic surfactant to soap in said particles lies in a range from 10:1 to 30:1, and wherein in addition to said particles the tablet or region contains 15% or more by weight of the tablet or region respectively of a water-soluble material which is other than soap or organic surfactant and which is selected from the group consisting of compounds with a water-solubility exceeding 10 gm/liter water at 20° C.; sodium tripolyphosphate containing at least 50% of its own weight of the phase I anhydrous form, and mixtures thereof.

2. A tablet according to claim 1 wherein the said particles contain from 30 to 80% by weight of the particles of water-insoluble detergency builder.

3. A tablet according to claim 1 wherein the weight ratio of anionic surfactant to nonionic surfactant lies in a range from 5:1 to 1.7:1.

4. A tablet according to claim 1 wherein the said weight ratio of anionic surfactant to nonionic surfactant lies in a range from 4:1 to 2:1.

5. A tablet according to claim 1 wherein the said particles contain non-soap anionic surfactant in an amount which is at least 3% by weight of the tablet or region and nonionic surfactant in an amount which is at least 2% by weight of the tablet or region respectively.

6. A tablet according to claim 1 wherein the amount of non-soap organic surfactant in the said particles is from 22 to 40% by weight of the particles.

7. A tablet according to claim 1 wherein the 15% or more of water-soluble material present in addition to the said particles is in the form of further particles which contain no more than 5% of their own weight of organic surfactant.

8. A tablet according to claim 1 wherein the 15% or more of the water soluble material is selected from the group consisting of: anhydrous or hydrated sodium citrate, potassium carbonate, urea, anhydrous or hydrated sodium acetate, magnesium sulphate $7H_2O$, potassium acetate, sodium tripolyphosphate containing more than 50% of its own weight of the phase I anhydrous form and mixtures thereof.

9. A tablet according to claim 1 wherein the 15% or more of water soluble material is selected from the group consisting of sodium citrate, sodium citrate dihydrate, sodium acetate, sodium acetate trihydrate and mixtures thereof.

10. A tablet according to claim 1 which overall contains from 5 to 40% by weight of non-soap organic surfactant and from 10 to 80% by weight of detergency builder.

11. A tablet according to claim 1 wherein said anionic surfactant is a majority of sodium alkyl benzene sulphonate, optionally accompanied by a smaller amount of other anionic surfactant.

12. A tablet according to claim 1 wherein said nonionic surfactant is a majority of ethoxylated fatty alcohol, optionally accompanied by a smaller amount of other nonionic surfactant.

13. A tablet according to claim 1 wherein the said particles contain at least two-thirds of the water-insoluble builder in the tablet or region.

14. A process for making a detergent tablet according to claim 1 which comprises mixing from 30 to 65% by weight of particles which contain from 20 to 50% by weight of these particles of non-soap organic surfactant which is anionic and nonionic surfactants in a weight ratio from 5:1 to 1.5:1 and wherein the particles include soap and the weight ratio of nonionic-surfactant to soap in said particles lies in a range from 10:1 to 30:1, with 15% or more of material which is other than soap or organic surfactant and which is selected from the group consisting of compounds with a water-solubility exceeding 10 gm/liter water at 20° C.; sodium tripolyphosphate containing at least 50% of its own weight of the phase I anhydrous form and mixtures thereof and compacting the mixture into a tablet or a region of a tablet.

15. A process according to claim 14 wherein the said particles contain from 30 to 80% by weight of the particles of water-insoluble detergency builder.

* * * * *